US005826409A

United States Patent [19]

Slepicka et al.

[11] Patent Number: 5,826,409

[45] Date of Patent: Oct. 27, 1998

[54] METHOD AND APPARATUS FOR REMOVING BOTTLE CAPS FROM BOTTLES

[75] Inventors: Frank J. Slepicka, Berwyn; Douglas J. Hidding, Barrington, both of Ill.

[73] Assignee: Blackhawk Molding Co., Inc., Addison, Ill.

[21] Appl. No.: 661,924

[22] Filed: Jun. 11, 1996

[51] Int. Cl.[6] ..... B65B 43/26; B65B 43/38; B65B 43/40

[52] U.S. Cl. ..... 53/492; 53/72; 53/53; 53/381.4; 81/3.2

[58] Field of Search ..... 53/492, 381.4, 53/72, 53, 201; 81/3.2, 3.31

[56] References Cited

U.S. PATENT DOCUMENTS

| | | | |
|---|---|---|---|
| 2,940,229 | 6/1960 | Baker | 53/492 |
| 3,545,174 | 12/1970 | Randrup | 53/381.4 |
| 3,803,795 | 4/1974 | Ouellette et al. | 53/381.4 |
| 3,845,605 | 11/1974 | Hartness | 53/381.4 |
| 3,914,920 | 10/1975 | Dilanni | 53/381.4 |
| 4,070,854 | 1/1978 | Marino | 53/381.4 |
| 4,338,767 | 7/1982 | Cochran | 53/381.4 |
| 4,363,204 | 12/1982 | Ohude et al. | 53/381.4 |

FOREIGN PATENT DOCUMENTS

| | | | |
|---|---|---|---|
| 1632025 | 8/1970 | Germany | 81/3.2 |

*Primary Examiner*—John Sipos
*Assistant Examiner*—Gene L. Kim
*Attorney, Agent, or Firm*—Baker & McKenzie

[57] ABSTRACT

A bottle cap removing system which is easily adapted to a conveyor system of either 5-gallon or 3-gallon bottle movement within a bottling or recycling facility. Such system automatically determines which, if any, bottles have attached bottle caps and automatically removes such bottle caps in an efficient and cost-effective manner. Multiple lengths of steel comprise a main support structure which supports an overhead decapping assembly. As bottles from a conveyor line pass underneath this decapping assembly, a sensor determines whether or not the first bottle in the line has an attached bottle cap. If such bottle has an attached bottle cap, pneumatic actuators located at both the lower and upper front end of the support structure are energized to extend a set of bottle pads into the path of the bottle. This bottle's movement is thus stopped and its bottle cap situated immediately underneath the decapping assembly. At the same time, a separate, rearwardly positioned actuator extends another bottle pad into the line of bottles which succeed this first bottle to inhibit their movement as well. The decapping assembly is then lowered over the bottle cap and jaw members inserted underneath the cap's lowest edge. As the assembly is then lifted, the bottle cap is removed from the bottle and discharged out through a side chute. After the cap is removed, the bottle pads are retracted and the conveyor line of bottles allowed to move forward once again.

19 Claims, 9 Drawing Sheets

METHOD AND APPARATUS FOR REMOVING BOTTLE CAPS FROM BOTTLES

The present invention relates generally to automated machinery for removing caps from empty bottles and, more specifically, to a continuous system which receives a conveyor line of empty bottles, senses whether the first bottle in the line has an attached bottle cap and, if a cap is present, stops the forward movement of the bottle, positions that bottle underneath a decapping device, and then removes the bottle cap from that bottle, so that it can be cleaned and re-used.

BACKGROUND OF THE INVENTION

It is commonly known and practiced within the bottled water industry, and others, that detachable, plastic bottle caps are mounted on the neck of a variety of sizes and shapes of bottles. Such bottle caps seal the bottle and the contents inside prior to the installation of the bottle on a dispenser. In the water industry such use involves inversion of the bottle and placement of it onto a drinking water dispensing system. In the past, a cap on the bottle would be removed prior to use through the use of an attached pull tab and a scoreline.

Recent developments in the water bottle/bottle cap industry include a cap which has a central tube section that is capable of receiving a specialized water dispensing probe from a water dispensing system. This tube section has an inner seal which prevents the water from escaping the bottle until such dispensing probe is inserted. With this type of arrangement, the bottle cap itself need not be removed prior to placement of the bottle onto a water dispensing system. Indeed, at no time during the bottle's use by a consumer does the bottle cap ever have to be removed. As a result, water bottles which are being returned with these types of bottle caps still securely affixed thereon are cleaner and can be more easily re-used.

Obviously, the presence of these attached bottle caps forces bottlers and recycling plants to perform an additional labor task before the corresponding bottles may be refilled. One way of addressing this problem is to employ additional laborers to peel and/or pry off the bottle caps in a manual fashion. Such a method, however, is both costly and inefficient, particularly in comparison to the highly automated methods of handling other tasks known within the bottling industry today.

In light of the productivity deficiencies and additional costs associated with the process of removing bottle caps from bottles by hand, what is needed in this field of art is an automated system which can easily and inexpensively be adapted within a standard bottling plant and which can remove bottle caps from bottles moving along a conveyor-type system.

The advantages of the instant invention described above with reference to the bottled water industry are also applicable to other industries involved in the distribution of liquids, such as edible oils and liquid chemicals, and may also have application in industries involved in the distribution of flowable powders.

SUMMARY OF THE INVENTION

Accordingly, the apparatus and method for removing bottle caps of the present invention is a primarily pneumatically actuated system which is used in conjunction with a conveyor line of bottles. As bottles pass underneath the device, a decapping assembly is lowered over the bottle's bottle cap whereby jaws grasp and lift the bottle cap up and off of the bottle. Movement along the conveyor line is only minimally impeded.

The basic components of the present invention include a frame structure, a decapping assembly, a bottle positioning assembly and a bottle line stopping assembly. The frame assembly is adapted to fit over a conveyor system of bottle movement. The decapping assembly is mounted to the frame's structure in a position immediately above the bottles as they pass through the middle of the frame structure. The decapping assembly also has an adjustable height mechanism which may be employed to accommodate bottles of different heights.

The bottle positioning assembly consists of two inwardly extending bottle pads mounted to the support structure and which are able to stop the forward motion of a bottle and position it such that its cap is immediately underneath the decapping assembly. The bottle line stopping assembly is also mounted to the support structure and prohibits the forward movement of the entire line of bottles immediately behind the bottle which is to be decapped.

As a bottle moves along a conveyor path and into the area of the present invention, a sensor determines whether or not this bottle has an attached bottle cap. It should be noted that this system also accepts bottles which are in a crate, provided that the walls of the crate do not extend above the shoulder of the bottle. If it is determined that this bottle has a cap which must be removed, a signal is sent to both the bottle positioning assembly and the bottle line stopping assembly whereby the bottle is positioned immediately underneath the decapping assembly and any bottles which trail this first bottle will be prohibited from moving forward any further. As these bottles are relatively light, they can be held in place as the conveyor itself continues to roll forward.

Immediately thereafter, the decapping assembly is lowered over the top of the bottle cap. At this point, jaw members on the decapping assembly engage the cap. After such engagement, the entire decapping assembly is lifted whereby the bottle cap is removed from the bottle. As the decapping assembly reaches its highest vertical position, an air ejector system forces the bottle cap out of the decapping assembly and down through a cap discharge chute. Once this cycle is completed, the bottle positioning assembly and bottle line stopping assembly are both retracted so as to allow all bottles in the conveyor line to continue moving forward in accordance with the conveyor's movement until, of course, the sensor senses that another bottle has an attached bottle cap. The entire cap removing process for a single bottle takes approximately one to two seconds.

It is therefore a general object of the present invention to provide an automatic (non-manual) system of removing bottle caps from bottles of varying heights, whereby the adjustment between bottle sizes may be performed quickly and automatically.

A further object of the present invention is to provide an automatic bottle cap removing system having its automation based upon standard relay logic for ease of repair.

In addition, it is an object of the present invention to provide an automatic bottle cap removing system which may be incorporated into a standard conveyor-type system of bottle movement, which can be adjusted to correspond to a wide range of production rates and which can accommodate bottles that are contained within a crate or partial crate.

Similarly, it is an object of the present invention to provide an extremely quick means of removing bottle caps from bottles so as not to excessively slow down the movement of bottles along a conveyor.

Another object of the present invention is to automatically determine if a particular bottle does or does not have a cap attached to it which needs to be removed.

Moreover, an additional important object of this invention is to provide a system of automatically removing bottle caps from bottles whereby no damage will be imparted to the bottle.

An overall object of the present invention is to provide an automatic system for removing bottle caps from bottles which requires a minimal amount of power to operate.

Further objects and advantages of this invention will become apparent to those of ordinary skill in the pertinent art upon review of the following detail description, accompanying drawing, and appended claims.

BRIEF DESCRIPTION OF THE DRAWING

For a more complete understanding of this invention, reference should now be made to the embodiment illustrated in greater detail in the accompanying drawing and described below. In the drawing.

The figures are not necessarily to scale and the embodiments are sometimes illustrated by phantom lines and diagrammatic representations. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PREFERRED EMBODIMENTS

Figure 1:
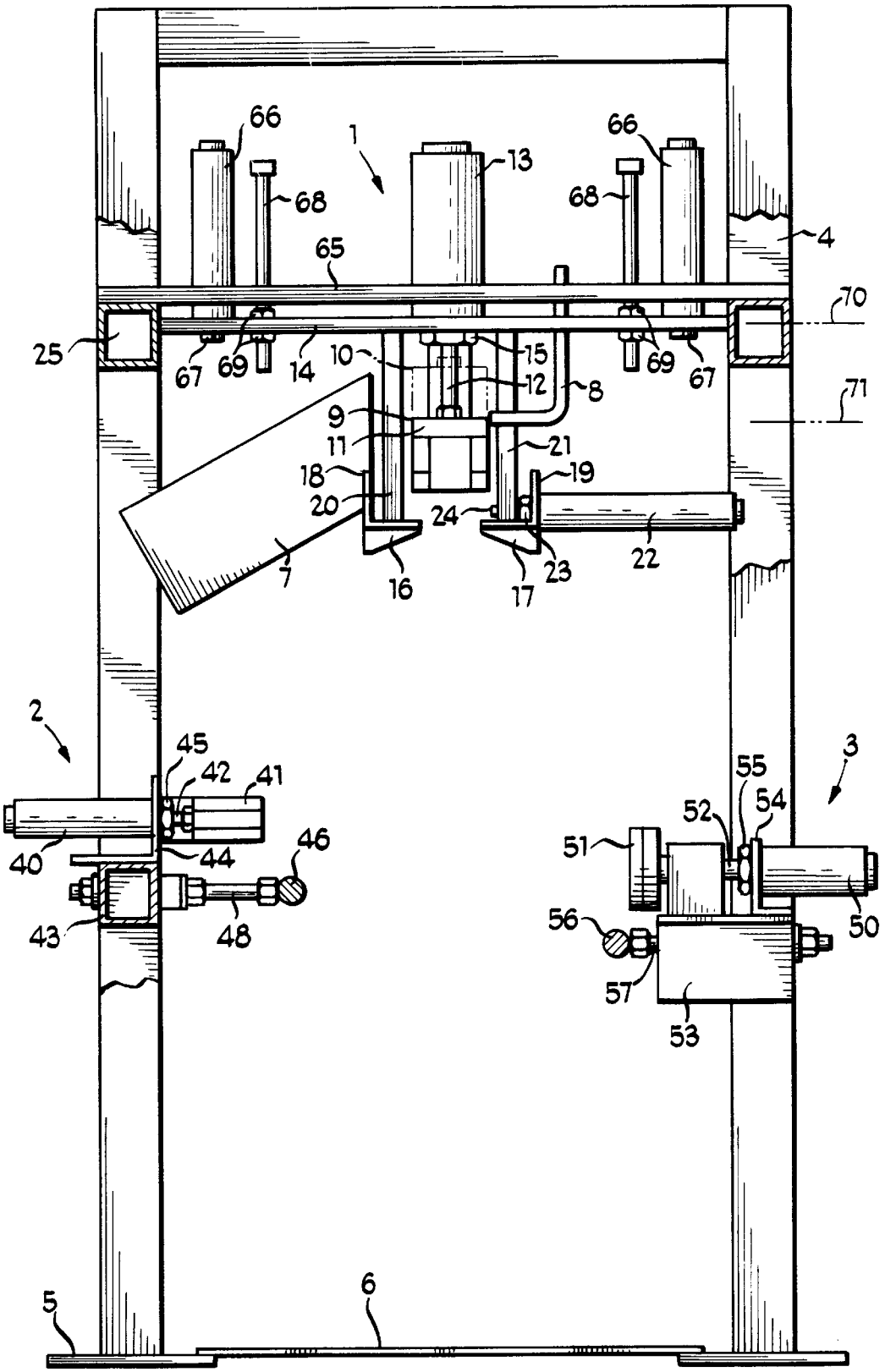
FIG. 1 is a front elevational view of the bottle cap removing system of the present invention.

Turning first to FIG. 1, there is shown a front elevational view of the bottle cap removing system of the present invention. Indicated generally at 1 is the decapping assembly, indicated generally at 2 is the bottle positioning assembly and indicated generally at 3 is the bottle line stopping assembly. Each of these assemblies is supported, in substantial part, by the main support frame 4. This main support frame 4 includes four equally-spaced vertical members —each secured to a base footing 5. Increased stability is added to the support frame 4 by affixing a stabilizing bar 6 between both the pair of rear base footings 5 and the pair of forward base footings 5. All of the above-noted elements are of stainless and/or aluminum construction for durability, strength and low maintenance; use of stainless steel is preferred.

The decapping assembly 1 as shown in FIG. 1 includes a decapper head cylinder 13 which is mounted to adjustable support plate 14 with the cylinder nut 15. Adjustable support plate 14 is a substantially rectangular sheet of steel which is supported by stationary support plate 65 which is, in turn, supported by crossbeams 25 of the main support frame 4. Specifically, adjustable support plate 14 is secured to the pistons of support plate cylinders 66 via cylinder nuts 67. Cylinders 66 are firmly affixed to stationary support plate 65 and may automatically position adjustable support plate 14 at either a large bottle height 70 or a lower bottle height 71. Stability of the adjustable support plate 14 is further enhanced by the insertion of safety rods 68 through stationary support plate 65 and their affixation to adjustable support plate 14 with rod nuts 69. Such arrangement ensures the proper vertical alignment of the adjustable support plate 14 with respect to the bottles.

Decapper head cylinder 13 also includes a decapper head piston 12 which is further attached to the movable decapper head 11. The pneumatically actuated decapper head cylinder 13, mounted in a substantially vertical position, may extend and retract its decapper head piston 12 such that the movable decapper head 11 may extend to a lowered position 9 or retract to a raised position 10.

Also included as part of the decapping assembly 1 are the left neck pad 16 and the right neck pad 17. Left neck pad 16 is secured to the left neck pad bracket 18 which, in turn, is attached to the left support beam 20. Left support beam 20 is a downward extension off of adjustable support plate 14 and allows the left neck pad 16 to be positioned at a horizontal level just above the upper surface of a bottle container. Right neck pad 17 is positioned similarly to left neck pad 16 and is attached to right neck pad bracket 19. Right neck pad bracket 19 is secured to the bottle neck positioning cylinder 22 via the cylinder nut 23. The right and left neck pads, 16 and 17, stabilize the bottle and limit its upward movement as the bottle cap is lifted from the neck of the bottle.

The positioning cylinder 22 has an extendable neck positioning piston 24 which is then mounted to the right support beam 21—a downward extension off of adjustable support plate 14. The positioning cylinder 22 may move the piston 24 to either an inward position (shown) or an outward position (not shown) by either retracting or extending its neck positioning piston 24, for purposes of stopping a capped bottle (piston extended) or allowing passage of an uncapped bottle (piston retracted), as appropriate based upon the signal of the sensor used to sense the presence of a cap on a bottle. Piston 24 (in its inward position) allows only the neck of a bottle to pass between the neck pads, whereby the neck pads may then substantially prevent the upward movement of the bottle as its cap is being removed.

FIG. 1 also illustrates the means by which bottle caps, once removed, are ejected from the decapping assembly 1 and discharged into a collection area. Once a bottle cap is removed and the movable decapper head 11 is retracted to its raised position 10, a powerful stream of compressed air from the air ejector 8 blows the bottle cap out of the decapping assembly 1 and down through the cap discharge chute 7. Bottle caps may then be collected by simply placing a box, for example, at the end of this cap discharge chute 7.

Referring now to the bottle positioning assembly 2 in FIG. 1, what is shown is a bottle pad cylinder 40 connected to a bottle pad bracket 44 by a cylinder nut 45. This pneumatically actuated bottle pad cylinder 40 has a bottle pad piston 42 which may extend or retract the attached bottle pad 41.

Bottle pad bracket 44 is mounted upon crossbeam 43 of the main support frame 4. Also affixed to this crossbeam 43 is a threaded rod 48 which positions the substantially horizontal left bottle guide rail 46. Please note that there is a second bottle positioning assembly 2 (not shown) directly across from the bottle positioning assembly 2 which is shown, and is positioned behind the bottle line stopping assembly 3 illustrated in FIG. 1. The detailed operation of the bottle positioning assemblies 2 will be discussed in accordance with FIG. 4.

Lastly, FIG. 1 also shows the bottle line stopping assembly 3 which primarily includes the bottle line cylinder 50, stop pad piston 52 and bottle line stop pad 51. Bottle line cylinder 50 is connected to line cylinder bracket 54 by the cylinder nut 55. The generally L-shaped line cylinder bracket 54 is then securely mounted to the stop pad bracket 53 which is mounted to the side of the main support frame 4. Bottle line cylinder 50 is pneumatically actuated and may extend its stop pad piston 52 to move the bottle line stop pad 51 to an inward position. Immediately beneath the bottle line cylinder 50 is an end view of the right bottle guide rail 56 connected to the main support frame 4 by the threaded rod 57. Further detailed operation of the bottle line stopping assembly 3 will be discussed in accordance with FIG. 4.

Figure 2:
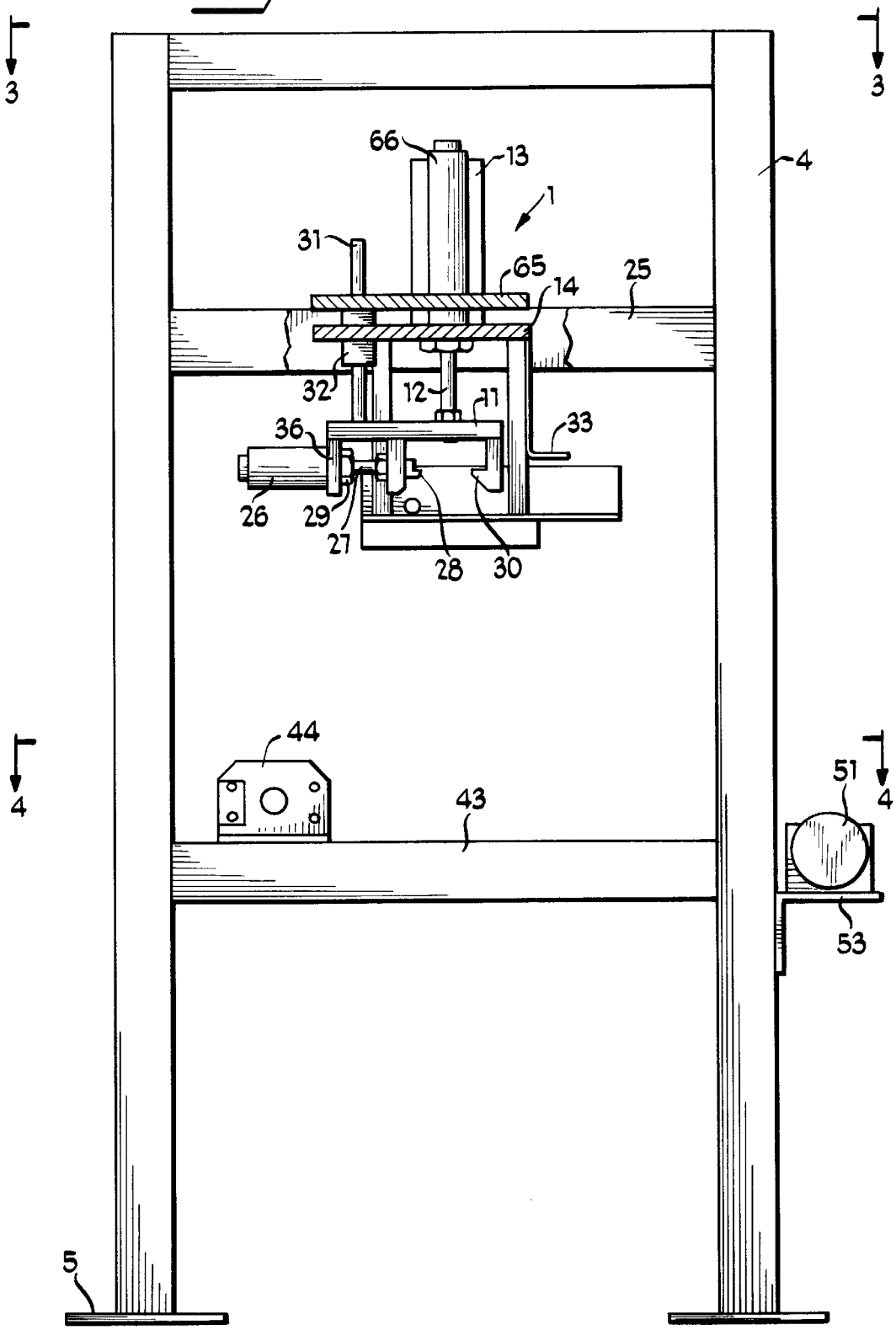
FIG. 2 is a side elevational view of the bottle cap removing system of the present invention.

Referring now to FIG. 2, a side perspective view of the bottle cap removing system is illustrated. This view offers some additional detail to the decapping assembly 1. Specifically, a vertical positioning rod 31 is attached to the movable decapper head 11 and is movably contained within positioning rod sleeve 32. Positioning rod sleeve 32 is integrally formed within the adjustable support plate 14 whereby the vertical positioning rod 31 is allowed to move in an up-and-down fashion in accordance with the extended or retracted movement of the decapper head piston 12, thus supplying additional stability to the movable decapper head 11.

Extending downwardly from the movable decapper head 11 is the cylinder support member 36 through which the removal jaw cylinder 26 is mounted using cylinder nut 29. Pneumatically actuated removal jaw cylinder 26 includes a removal jaw piston 27 which is attached to rear removal jaw 28. By extending or retracting the removal jaw piston 27, the removal jaw cylinder 26 may also extend or retract rear removal jaw 28 with respect to front removal jaw 30. Front removal jaw 30 is securely affixed to the underside of movable decapper head 11. Detailed operation of rear removal jaw 28 and front removal jaw 30 will be discussed in accordance with FIG. 5.

Also shown in FIG. 2 is bottle cap sensor 33 attached to adjustable support plate 14. Sensor 33 is a proximity sensor which determines whether or not a bottle positioned immediately beneath it has an attached bottle cap. If so, a signal is sent to the decapping assembly 1, the bottle positioning assembly 2 and the bottle line stopping assembly 3 whereby a decapping procedure is initiated. If the bottle cap sensor 33 does not detect the presence of a bottle cap, the bottle will simply proceed through the confines of the present invention untouched.

This side view of FIG. 2 also shows the approximate location of the bottle pad bracket 44 mounted upon the crossbeam 43, as well as the bottle line stop pad 51 mounted upon stop pad bracket 53. Stop pad 51 is deliberately mounted forward of bottle pad bracket 44 as its function is to stop the forward movement of the line of bottles which are behind the particular bottle which is being decapped.

Figure 3:
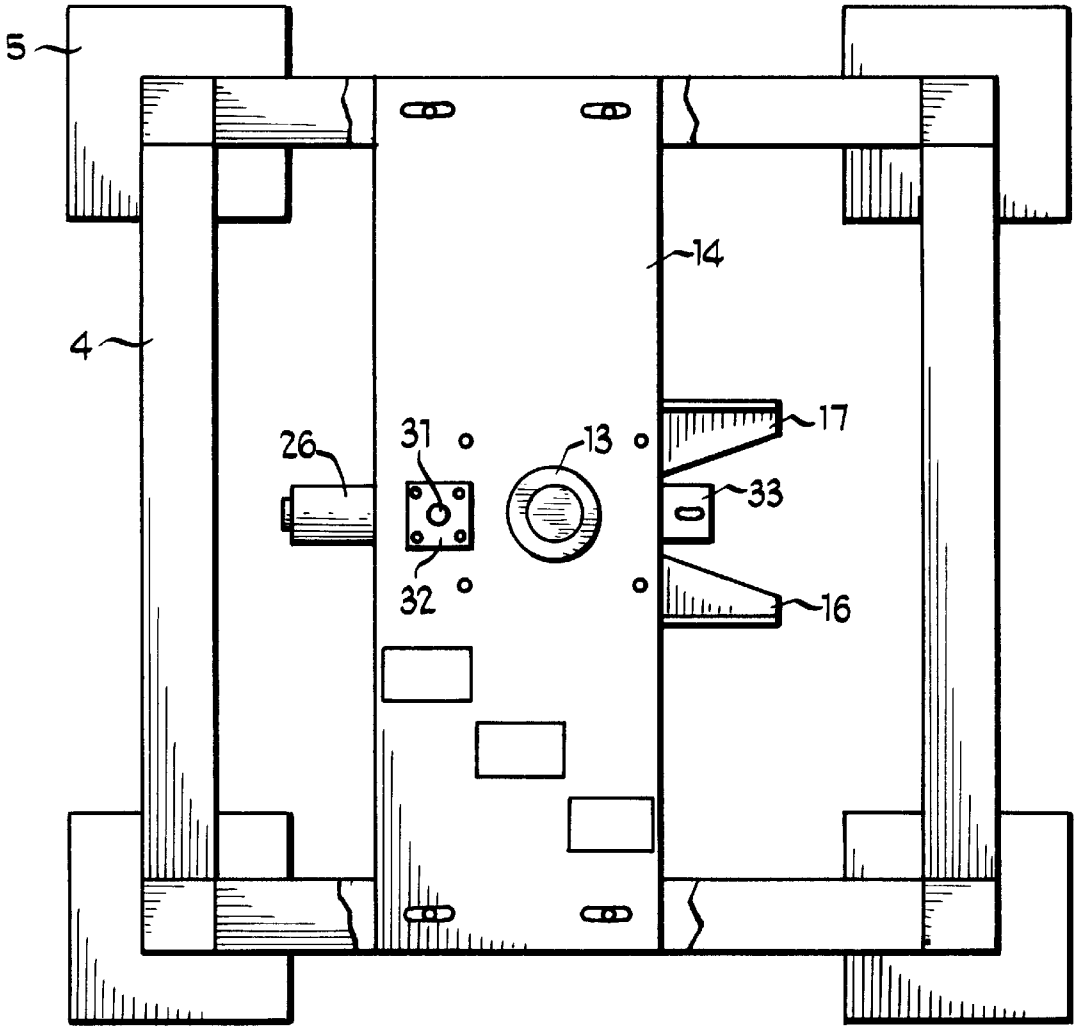
FIG. 3 is a top plan view of the present invention taken along line AA of FIG. 2.

FIG. 3 is a top elevational view of the bottle cap removing system shown in view AA from FIG. 2. Here the dimensions of the adjustable support plate 14 can be seen as well as the approximate locations of the removal jaw cylinder 26, vertical positioning rod 31, positioning rod sleeve 32, decapper head cylinder 13, left neck pad 16, right neck pad 17 and bottle cap sensor 33. Left neck pad 16 and right neck pad 17 have inwardly formed inner surfaces which help to guide the neck, and bottle cap, of a bottle underneath the bottle cap sensor 33 and into the decapper section.

Figure 4:
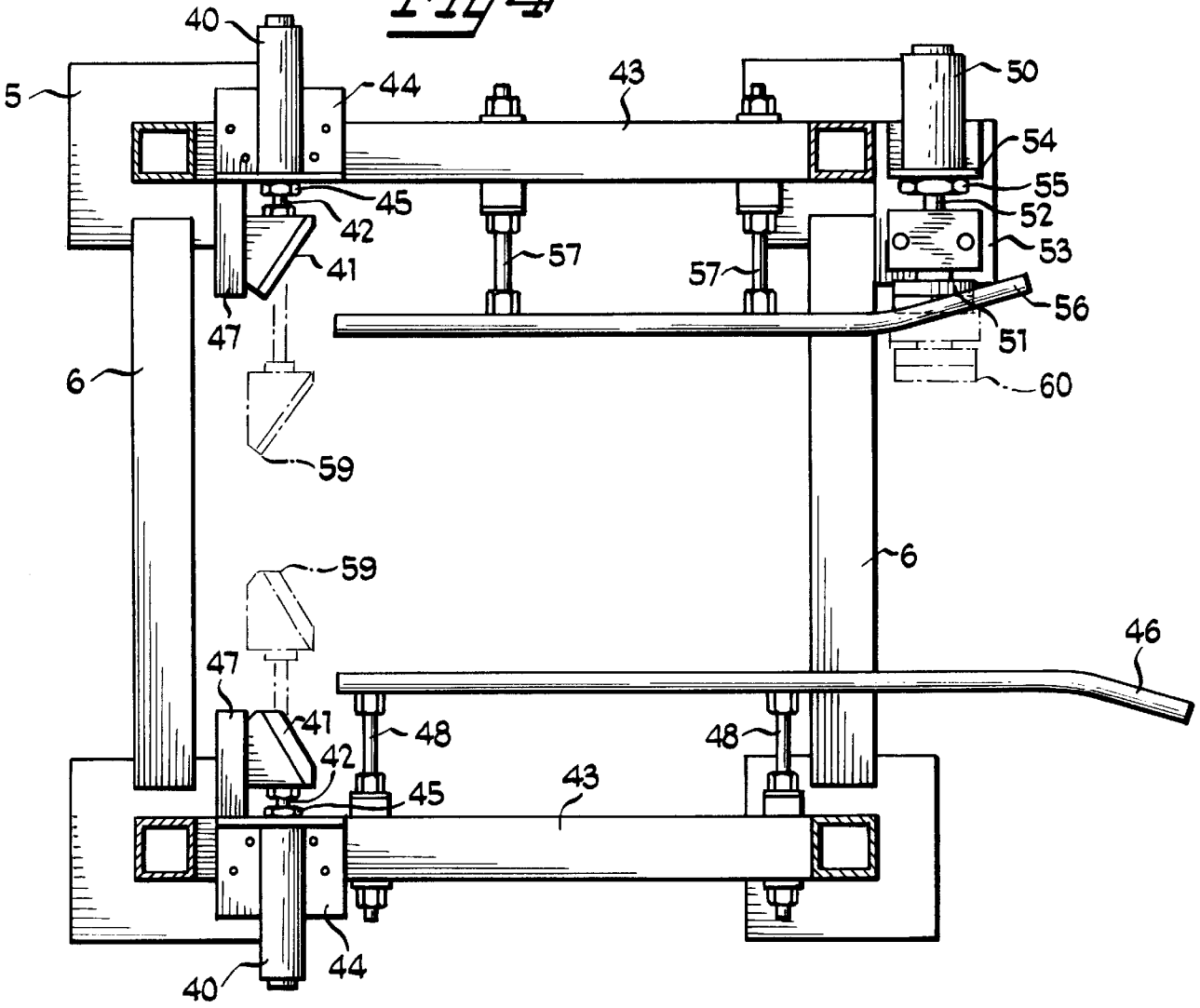
FIG. 4 is a sectional view of the present invention taken along line BB of FIG. 2.

Turning now to FIG. 4, what is shown is a top elevational view of the bottle cap removing system offering view BB from FIG. 2. This view shows the approximate relative positions of both the left bottle guide rail 46 and right bottle guide rail 56. These rails are adjustably positioned to narrowly accommodate a single conveyor line of bottles. If it is determined that a bottle has an attached bottle cap, bottle pad cylinders 40 will extend their bottle pad pistons 42 to position their bottle pads 41 toward the center of the conveyor line. Such extended position is indicated at 59. At the same time, bottle line cylinder 50 will extend its stop pad piston 52 to push its bottle line stop pad 51 into the side of the bottle immediately behind the bottle being decapped whereby this bottle is subsequently forced into immovable engagement with left bottle guide rail 46. By using the stop pad 51 to inhibit the movement of this bottle, the entire conveyor line of bottles is prevented from moving into the decapping area while the bottle is being decapped. It must be noted that while these bottles are prevented from their forward movement along the conveyor line, the conveyor itself need not be stopped. Indeed, the relative light weight of these bottles allows the conveyor to simply glide underneath the bottles during a decapping procedure. After a decapping procedure is completed, bottle pads 41 and bottle line stop pad 51 are retracted to once again allow the forward movement of the conveyor line of bottles.

Figure 5:
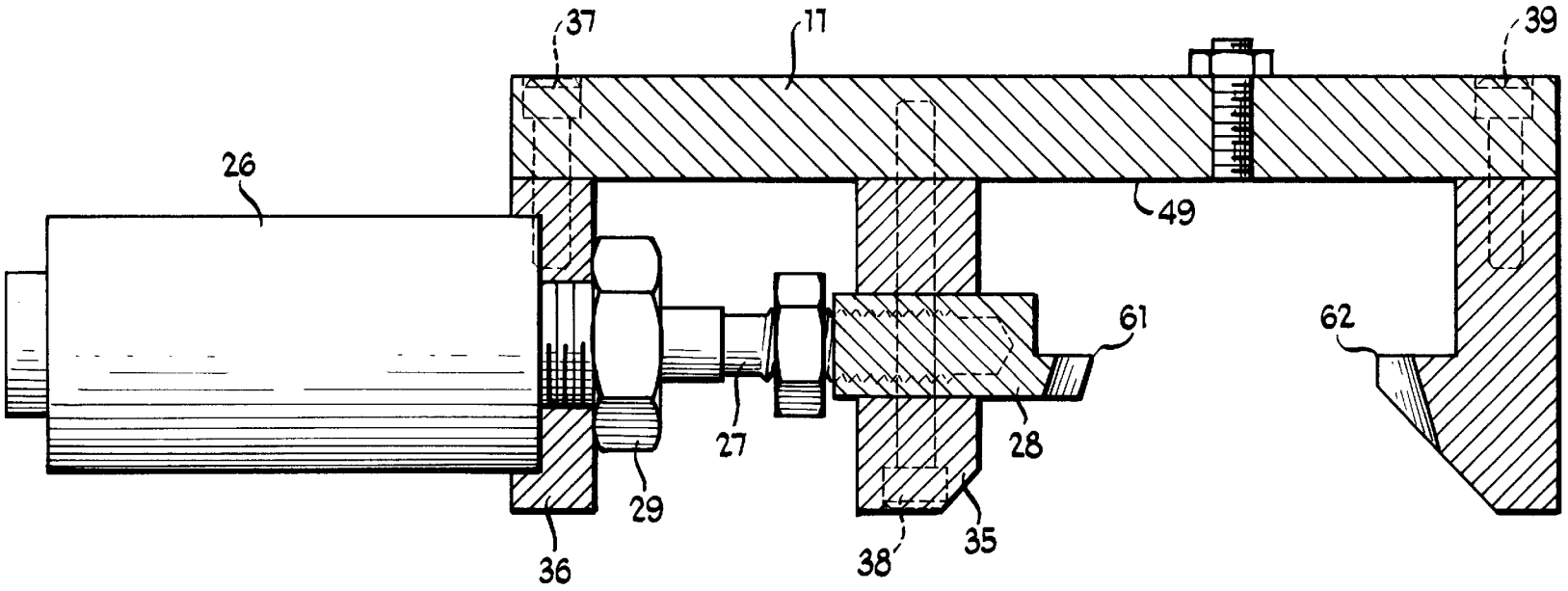
FIG. 5 is an enlarged side view of a portion of the decapping assembly of the present invention.

FIG. 5 is a side cross-sectional view of the decapping assembly 1 of the present invention. The underside 49 of movable decapper head 11 will come into contact with a top surface of a bottle cap when the movable decapper head 11 is moved to its lowered position by the decapper head cylinder 13 (not shown). After such lowering of the movable decapper head 11, the rear jaw lip 61 of rear removal jaw 28 and front jaw lip 62 of front removal jaw 30 are at a horizontal position slightly below the bottom edge of a cap. Subsequently, removal jaw cylinder 26 will extend its removal jaw piston 27 to force the rear removal jaw 28 into contacting relation with the neck of a bottle. Most importantly, this procedure then engages the rear jaw lip 61 and front jaw lip 62 with the bottom edge of a cap. As the movable decapper head 11 is then retracted into its raised position, the rear removal jaw 28 and front removal jaw 30 pull the bottle cap up and off of the bottle. FIG. 5 also illustrates how cylinder support member 36 is joined to the movable decapper head 11 through the use of a machine screw 37. Likewise, machine screw 38 affixes removal jaw sleeve 35 to the movable decapper head 11 and machine screw 39 secures the front removal jaw 30 to the movable decapper head 11.

Figure 6:
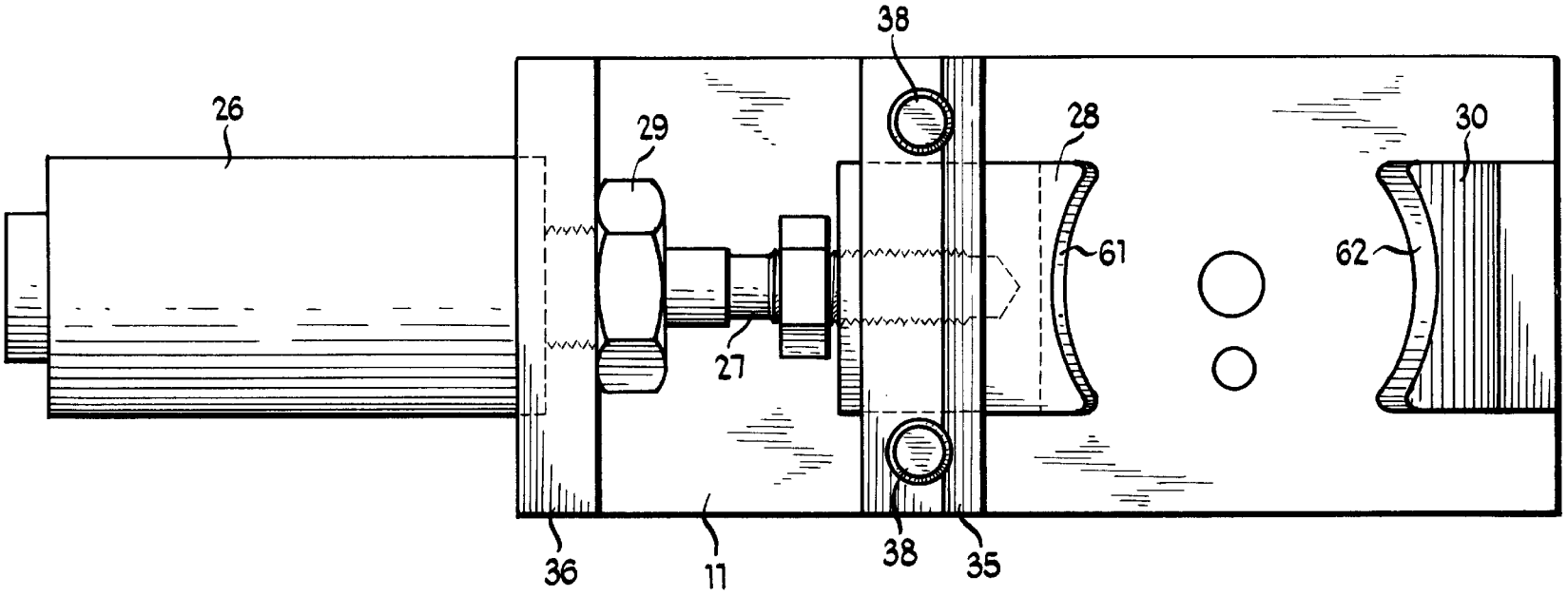
FIG. 6 is an enlarged view of a portion the decapping assembly of the present invention.

FIG. 6 presents a bottom view of the decapping assembly apparatus shown in FIG. 5. Specifically, rear jaw lip 61 and front jaw lip 62 are particularly formed in a concave fashion to accommodate the corresponding shape of the bottle cap.

Figure 7:
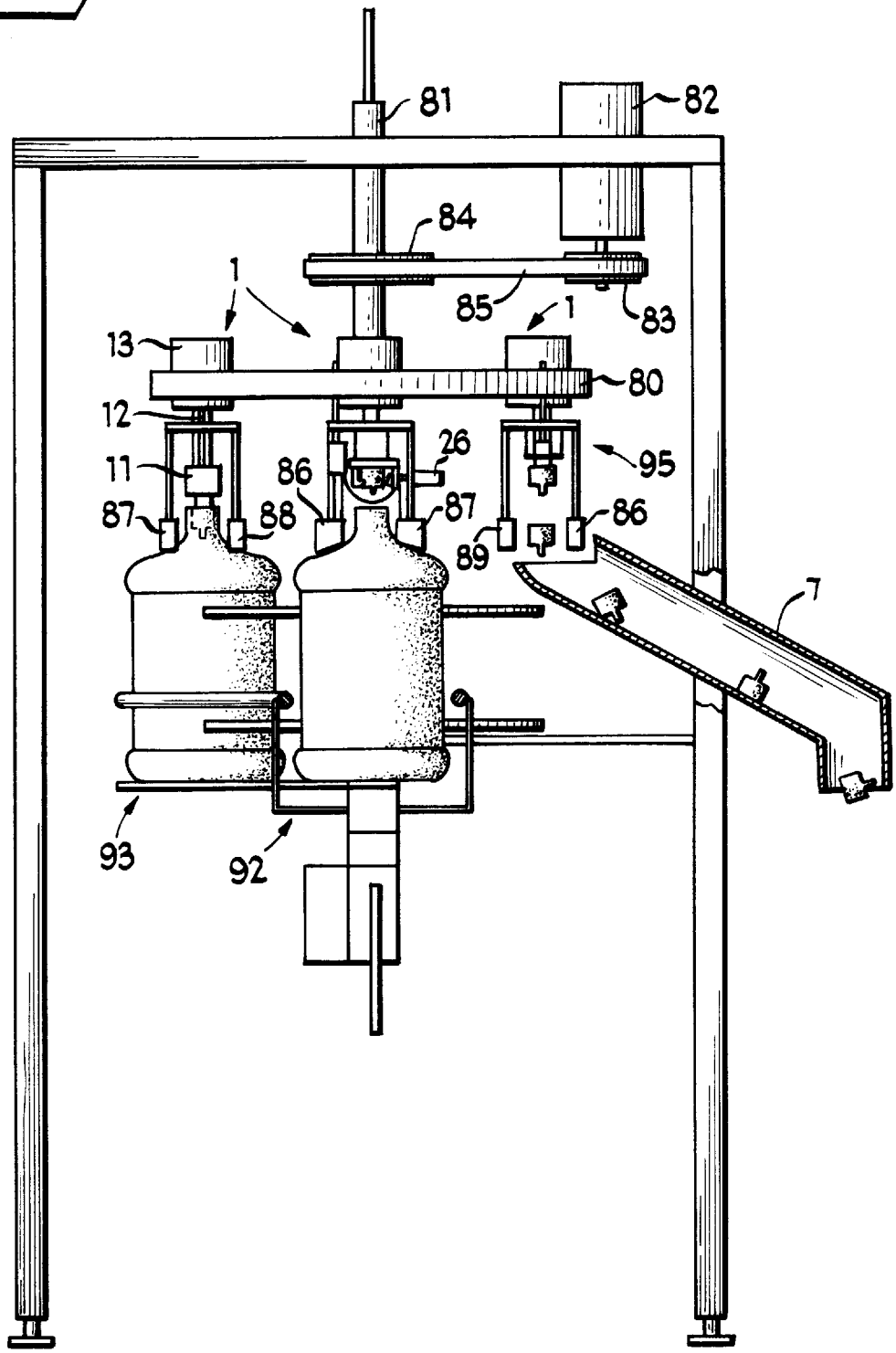
FIG. 7 is rear elevational view of an alternative embodiment of the present invention which incorporates a rotary decapping system.

Looking now to FIG. 7, an alternative embodiment of the present invention is shown wherein a "rotary" system of bottle cap decapping is incorporated into the overall process. This alternative embodiment includes four separate decapping assemblies 1, each of which is fully-equipped with a movable decapper head 11, decapper head piston 12, decapper head cylinder 13 and removal jaw cylinder 26. While four decapping assemblies are shown, a number of assemblies other than four could be utilized. The decapping assemblies 1 are mounted upon a rotary mounting piece 80. Rotary mounting piece 80 is connected to rotary axle 81 whereby it is rotated in a counter-clockwise manner (when viewed from the top, as shown by the arrows in FIG. 9), 90-degrees at a time, by motor 82. Specifically, motor 82 drives gear 83 which, in turn, drives gear 84 of axle 81 through the use of a belt 85.

Each time that the rotary mounting piece 80 is rotated 90-degrees, one of the individual decapping assemblies 1 is positioned over the bottle which is entering the machine at first position 92. As shown in FIG. 7, this bottle is secured, in part, underneath decapping assembly 1 by front left neck pad 86 and front right neck pad 87. As rotary mounting piece 80 then rotates another 90-degrees, front left neck pad 86 and front right neck pad 87 guide this bottle along an arcuate path to second position 93. At second position 93 and fourth position 95 it can be seen that there is also a rear right neck pad 88 and a rear left neck pad 89, respectively. The four neck pads 86, 87, 88 and 89 cumulatively serve to secure a bottle in position as it moves from one position to another and as an associated decapping assembly 1 removes its cap.

Pursuant to this rotary decapping process; (1) a bottle is initially positioned underneath a decapping assembly 1 at first position 92, (2) the bottle is rotated to second position 93 whereby moveable decapper head 11 is lowered upon the bottle cap, (3) the bottle is rotated to third position 94 (not shown) whereby moveable decapper head 11 removes the bottle cap from the bottle, and (4) the bottle exits the machine from third position 94 (see FIG. 9 description) while decapping assembly 1 rotates to fourth position 95 to eject the cap into discharge chute 7.

Figure 8:
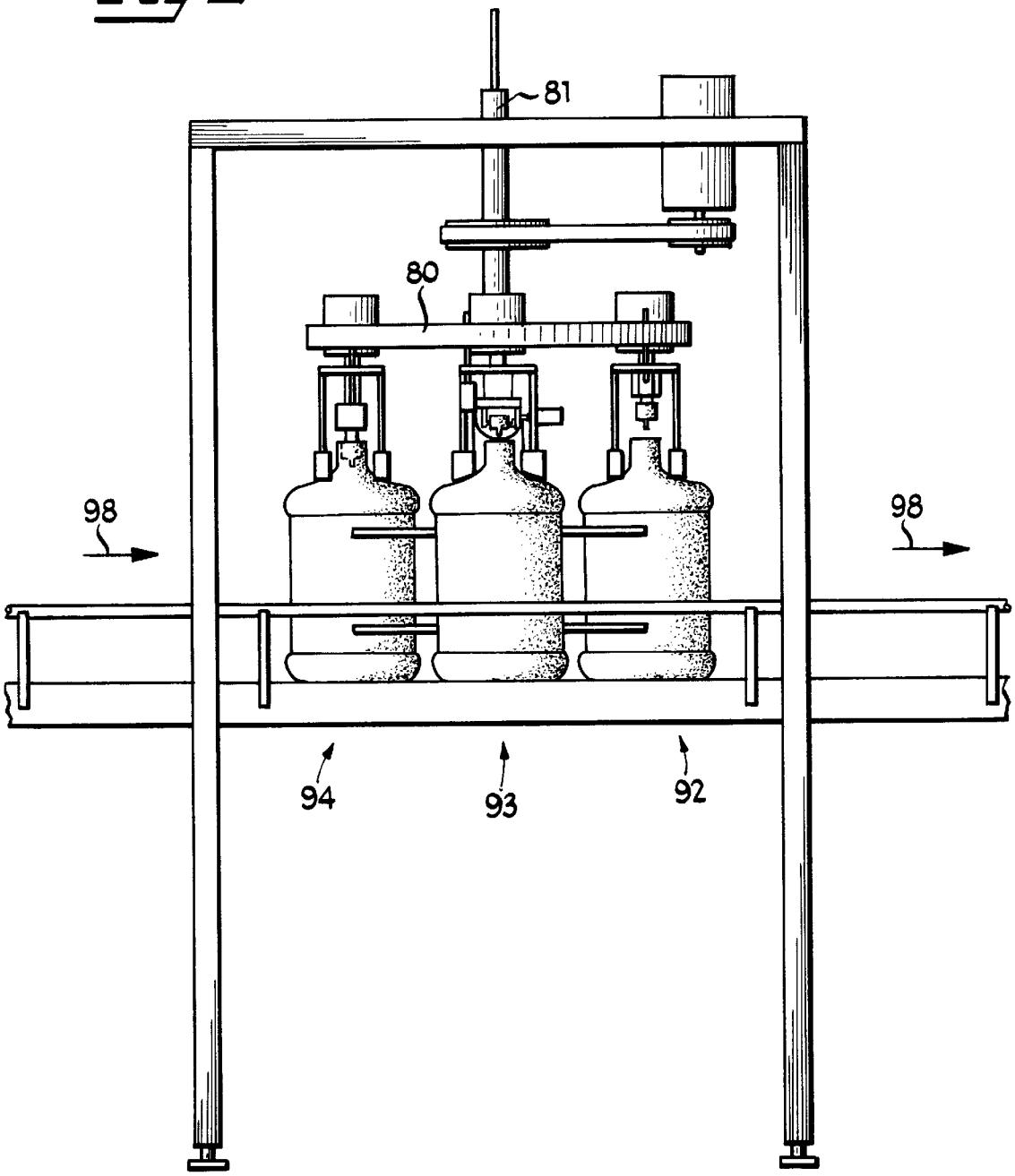
FIG. 8 is a side elevational view of the alternative embodiment of the present invention shown in FIG. 7.

FIG. 8 shows a side view of the rotary alternative embodiment of the present invention whereby bottles move through the apparatus in the direction of the conveyor flow 98. A bottle enters the machine and is secured at first position 92. Upon the first 90-degree rotation of rotary mounting piece 80, the same bottle is moved into second position 93. At second position 93, moveable decapper head 11 is lowered down upon the bottle's cap in preparation for removal. Upon the next 90-degree rotation of rotary mounting piece 80, the bottle is moved into third position 94. At third position 94, moveable decapper head 11 is then raised whereby the cap is removed from the bottle.

Figure 9:
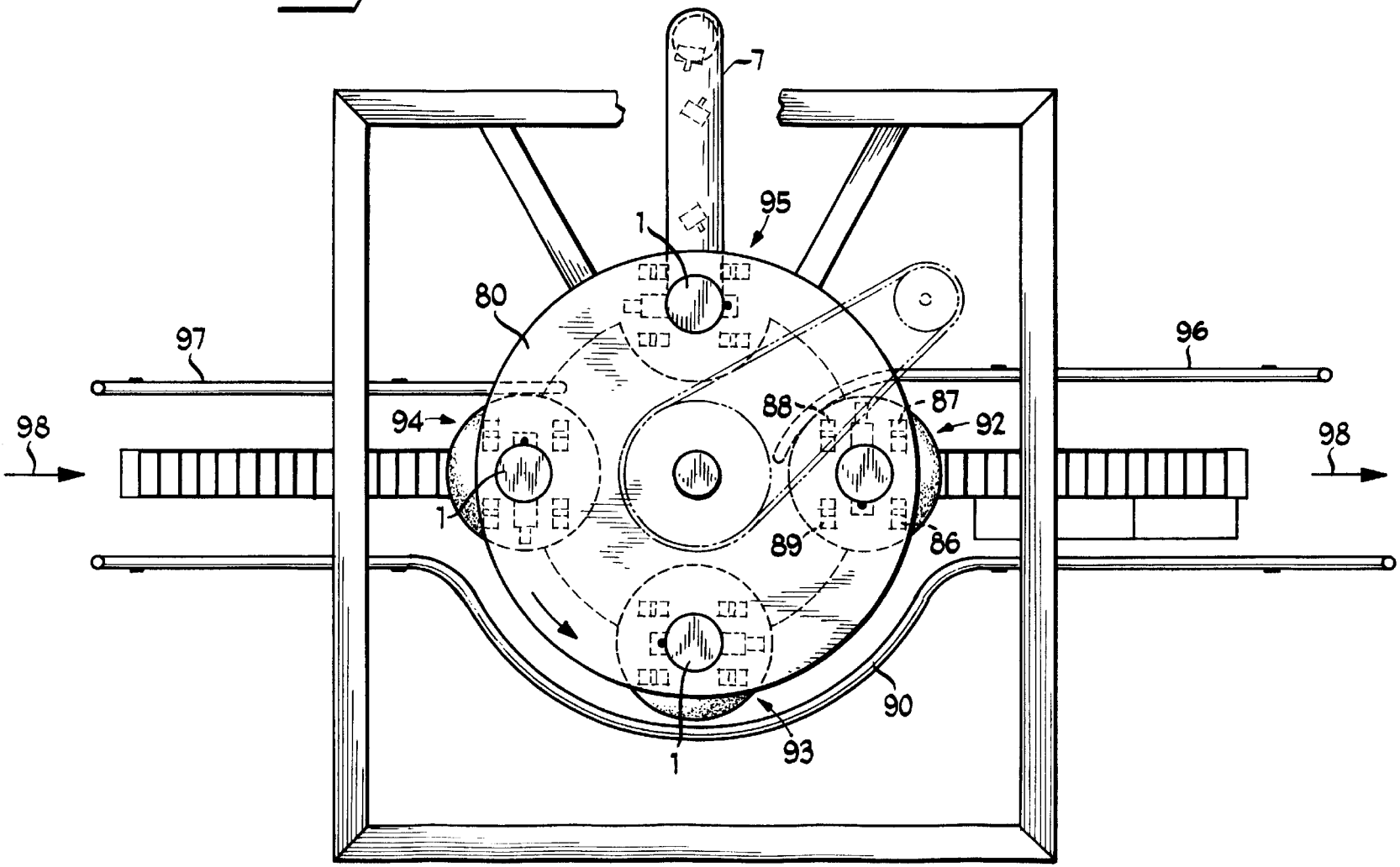
FIG. 9 is a plan view of the alternative embodiment of the present invention shown in FIG. 7.

Lastly, the true rotational aspect of the alternative embodiment of the present invention may be observed in FIG. 9. A bottle which moves toward the machine in the direction of the conveyor flow 98 is guided into first position 92 by entry guide rail 96 and outer guide rail 90. As rotary mounting piece 80 is then rotated 90-degrees, neck pads 86, 87, 88 and 89 and outer guide rail 90 guide the bottle along an arcuate path to second position 93. At second position 93, decapping assembly 1 is lowered down upon the bottle's cap in preparation for the cap's removal.

Upon the next 90-degree rotation of rotary mounting piece 80, the bottle is further guided along an arcuate path to third position 94 whereupon decapping assembly 1 removes the cap from the bottle. It should be noted that the bottle's rotational movement is ultimately restricted by exit guide rail 97 once it reaches third position 94. Once released from the grasp of decapping assembly 1 at third position 94, the bottle is guided out of the machine in the direction of the conveyor flow 98 by exit guide rail 97 and outer guide rail 90.

As rotary mounting piece 80 is rotated another 90-degrees, decapping assembly 1 moves into fourth position 95, still holding the bottle cap which was previously removed at third position 94, whereupon the cap is then ejected down discharge chute 7.

It should be understood that the particular operation of the decapping assemblies 1 in the alternative embodiment is essentially the same as that for the preferred embodiment as described in connection with FIGS. 1, 2, 5 and 6; the alternative embodiment merely providing an optional way of incorporating multiple decapping assemblies into a single machine rather than just one.

It should also be understood that the above described embodiments are intended to illustrate, rather than limit, the invention and that numerous modifications could be made thereto without departing from the scope of the invention as defined by the appended claims. Indeed, this invention contemplates the use of a variety of "gripping means" by which to remove a bottle cap. For example, negative pressure techniques (suction) or a device which applies ample pressure to the sides of a bottle cap should be deemed well within the scope of the present invention.

While the present invention has been illustrated in some detail according to the preferred embodiment shown in the foregoing drawing and description, it will become apparent to those skilled in the pertinent art that variations and equivalents may be made within the spirit and scope of that which has been expressly disclosed. Accordingly, it is intended that the scope of the invention be limited solely by the scope of the hereafter appended claims and not by an specific wording in the foregoing description.

We claim:

1. An apparatus for removing bottle caps from liquid-containing bottles, comprising:

(a) a decapping assembly support member;

(b) one or more decapping assembly heads;

(c) one or more first actuators mounted to said support member, each of said one or more assembly heads attached to, and corresponding to, one of said one or more first actuators wherein an underside of each assembly head may be lowered into a position adjacent to a cap;

(d) one or more sets of jaw members corresponding to each of said one or more assembly heads;

(e) one or more second actuators, each of said one or more second actuators mounted to one of said one or more assembly heads, at least one jaw member of each of said sets of jaw members being attached to each of said second actuators and at least one jaw member of each of said sets of jaw members being mounted on said underside of each of said one or more assembly heads, wherein said jaw members are positioned on opposite sides of said cap when said underside of each of said assembly heads is in proximate relationship with said cap and wherein each of said second actuators moves its corresponding jaw member so that said jaw members may be relatively positioned to engage said cap when said underside of each of said assembly heads is in proximate relationship with said cap; and (f) means for limiting upward movement of a bottle as each of said first actuators raises said corresponding assembly head after said jaw members engage said cap.

2. The apparatus for removing bottle caps as in claim 1, wherein said apparatus may be used in conjunction with a conveyor system of bottle movement and further comprises a system frame structure and a set of bottle guide rails, said support member mounted to said frame structure at a designated vertical height.

3. The apparatus for removing bottle caps as in claim 2, further comprising means for temporarily stopping a forward movement of a conveyor line of bottles wherein a first bottle is positioned substantially underneath a central point between said set of jaw members.

4. The apparatus for removing bottle caps as in claim 3, further comprising means for sensing whether or not said first bottle in said conveyor line has an attached bottle cap.

5. The apparatus for removing bottle caps as in claim 1, further comprising means for automatically ejecting said bottle cap from said set of jaw members and means for discarding said bottle cap into a collection area.

6. The apparatus for removing bottle caps as in claim 1, wherein said means for limiting upward movement of a bottle further comprises a pair of upper bottle pads mounted to said support member on opposite sides of a neck of said bottle, said upper bottle pads having lower surfaces positioned slightly above a sloping upper surface of said bottle.

7. The apparatus for removing bottle caps as in claim 3, wherein said means for temporarily stopping a forward movement of a conveyor line of bottles comprises a plurality of lower bottle pads, each of said lower bottle pads being movable into a path of said conveyor line by a lower actuator mounted on said system frame structure wherein an outer surface of a bottle comes into abutting contact with at least one of said lower bottle pads.

8. The apparatus for removing bottle caps as in claim 4, wherein said means for sensing whether or not a first bottle in a bottle line has an attached bottle cap comprises a proximity sensor mounted to said support member.

9. The apparatus for removing bottle caps as in claim 5, wherein said means for automatically ejecting said bottle cap from said set of jaw members includes a compressed air discharge tube mounted to said support member and horizontally directed to a side of said apparatus.

10. A method of removing bottle caps from liquid-containing bottles, comprising the steps of:

(a) lowering a decapping assembly having an underside, an actuator mounted to the assembly and a set of jaw members, at least one jaw member of the set of jaw members being attached to the actuator and at least one jaw member of the set of jaw members being mounted to the underside of the assembly, over a cap so that said jaw members are positioned on opposite sides of said cap;

(b) activating said actuator thereby gripping said cap with said set of jaw members of said decapping assembly;

(c) pulling said cap up and off of a bottle with said decapping assembly; and (d) preventing substantial upward movement of said bottle when pulling said cap with said decapping assembly.

11. The method of removing bottle caps as in claim 10, wherein said method may be used in conjunction with a conveyor system of bottle movement and further comprises the step of temporarily stopping a forward movement of a line of bottles on said conveyor system wherein a first bottle in said line is positioned substantially underneath said decapping assembly.

12. The method of removing bottle caps as in claim 11, further comprising the steps of sensing whether or not said first bottle has a cap mounted upon it and, if so, allowing said lowering of said decapping assembly over said bottle cap.

13. The method of removing bottle caps as in claim 12, further comprising the step of ejecting said cap from said decapping assembly into a bottle cap collection area after said pulling of said cap up and off of said first bottle.

14. The method of removing bottle caps as in claim 13, further comprising the step of remobilizing said forward movement of said line of bottles on said conveyor system after said pulling of said cap up and off of said first bottle.

15. An apparatus for removing bottle caps from liquid-containing bottles, comprising:

(a) a decapping assembly support member;

(b) a decapping assembly head;

(c) a first actuator mounted to said decapping assembly support member, said decapping assembly head being attached to said first actuator wherein an underside of said decapping assembly head may be lowered into a position adjacent to a cap;

(d) a pair of jaw members;

(e) a second actuator, said second actuator mounted to said decapping assembly head, one of the jaw members being attached to and corresponding to said second actuator and one of the jaw members being mounted on said underside of said decapping assembly head, wherein said jaw members are positioned on opposite sides of said cap when said underside of said decapping assembly head is in proximate relationship with said cap and wherein said second actuator moves its corresponding jaw member so that said jaw members may be relatively positioned to engage said cap when said underside of said assembly head is in proximate relationship with said cap; and (f) means for limiting upward movement of a bottle as said first actuator raises said decapping assembly head after said jaw members engage said cap.

16. The apparatus of claim 15 wherein said apparatus may be used in conjunction with a conveyor system of bottle movement.

17. The apparatus of claim 16 further comprising means for temporarily stopping a forward movement of a line of bottles on said conveyor system wherein a first bottle in said line is positioned substantially underneath said decapping assembly head.

18. The apparatus of claim 17 further comprising means for sensing whether or not said first bottle has an attached bottle cap.

19. The apparatus of claim 15 further comprising means for automatically ejecting said bottle cap from said means for moving said bottle cap.

* * * * *